US007175239B2

(12) United States Patent
Chang

(10) Patent No.: US 7,175,239 B2
(45) Date of Patent: Feb. 13, 2007

(54) METHOD OF MANUFACTURING MESS SPONGES

(76) Inventor: Jone Chang, 4F, No. 57, Minhe St., Taipei (TW)

( * ) Notice: Subject to any disclaimer, the term of this patent is extended or adjusted under 35 U.S.C. 154(b) by 436 days.

(21) Appl. No.: 10/852,217

(22) Filed: May 25, 2004

(65) Prior Publication Data

US 2005/0264089 A1 Dec. 1, 2005

(51) Int. Cl.
*A47K 7/02* (2006.01)

(52) U.S. Cl. ..... 300/21; 15/209.1; 15/244.4

(58) Field of Classification Search ..... 300/21; 15/209.1, 223, 229.11, 244.1, 244.4
See application file for complete search history.

(56) References Cited

U.S. PATENT DOCUMENTS

| | | | | |
|---|---|---|---|---|
| 3,081,476 | A * | 3/1963 | Mosheim | 15/244.1 |
| 5,727,278 | A * | 3/1998 | Per-Lee | 15/229.11 |
| 6,439,144 | B1 * | 8/2002 | Chen | 112/475.06 |
| 2002/0152571 | A1 * | 10/2002 | Lee | 15/209.1 |

FOREIGN PATENT DOCUMENTS

| | | | |
|---|---|---|---|
| JP | 10-192188 | * | 7/1998 |
| TW | 423302 | | 2/2001 |
| TW | 491070 | | 6/2002 |
| TW | 502612 | | 9/2002 |

* cited by examiner

*Primary Examiner*—Mark Spisich
(74) *Attorney, Agent, or Firm*—Birch, Stewart, Kolasch, and Birch, LLP

(57) ABSTRACT

The present invention discloses a method of manufacturing mess sponges comprised of a sponge, a rope and a binder by using a folding method to repeatedly fold the sponge for several times into a flower-shaped structure having a plurality of pedals and a pistils/stamina. Since the sponge has a high density and adhesiveness for the soap and a powerful rubbing and scrubbing effect, which can be used for scrubbing a dirtier position of our body. The flower-shaped structure can also clean the smoother and softer parts of our body, and thus can greatly enhance the convenience of scrubbing human body, since the flower-shaped structure has a plurality of pedals and pistils/stamina. The present invention not only has a better appearance than other shower scrubbing tools, but also provides a more convenient way for its use.

9 Claims, 10 Drawing Sheets

METHOD OF MANUFACTURING MESS SPONGES

FIELD OF THE INVENTION

The present invention relates to a method of manufacturing mess sponges, more particularly to a method of tying and manufacturing mess sponges by repeatedly folding a sponge inward into a flower-shaped sponge having a plurality of pedals and pistils/stamina.

BACKGROUND OF THE INVENTION

In the structure of a conventional bath mess sponge as shown in the R.O.C. Patent Publication No. 423302 entitled "Bath towel structure" disclosed a mess sponge structure made by stacking one or more mesh layers of equal and appropriate length together, which is very thin and not dense enough and thus resulting in a very weak capability of adhering soap.

Further, the conventional mess sponge is formed by wrapping a mesh bath towel into a spherical shape, but its capability of adhering soap is still not high enough. The whole structure is loose and thus resulting in an insufficient rubbing force because the structure is twisted excessively when being used for rubbing a dirtier body. It is necessary to compress the sponge densely, laboriously, and inconveniently to improve the rubbing force of the sponge. Furthermore, the combination of its stylish appearances is limited and not artistic.

In view of the foregoing mesh structures having a capability of adhering soap according to the R.O.C. Patent Publication No. 491070 entitled "Bath sponge structure" and the R.O.C. Patent Publication No. 502612 entitled "Bath sponge structure" are made of a soft PE film material with a very strong capability of adhering soap. However, the manufacturing process for binding the prior-art bath sponge requires lots of labor hours and processes, which will be a burden to the cost. In view of such shortcoming, the present invention provides a method of manufacturing mesh sponges by adopting a soft PVA film material, not only simplifying the binding process, but also improving its artistic appearance.

SUMMARY OF THE INVENTION

The primary objective of the present invention is to overcome the foregoing shortcoming and avoid the exiting deficiency. The present invention provides a method of manufacturing mess sponges by repeatedly folding a sheet sponge inward into a flower-shaped structure having a plurality of pedals and a pistil/stamen.

The secondary objective of the present invention is to provide a mess sponge structure which can be used to rub a dirtier body and cleaning a smoother part of the body due to its high density, good capability of adhering soap and strong rubbing force.

The mess sponge structure according to the invention comprises: a sponge, being in a sheet shape and having at least one stylish edge; a rope, having a knot and a plurality of yarns; and a binder, having a binding function.

The method of manufacturing mess sponges according to the invention combines the foregoing elements into a flower-shaped structure by a repeated folding method, comprising the steps of:

(1) preparing at least one sheet sponge and a rope;

(2) putting an end of the rope having a knot on a stylish edge of the sponge;

(3) folding the sponge with a specific distance around the periphery of the knot along the wavy edge of the sponge, and then repeatedly folding the sponge with a specific distance in the same folding direction; and (4) using a binder for fixing after folding the sponge for several times to produce a complete flower-shaped structure.

DETAILED DESCRIPTION OF THE PREFERRED EMBODIMENTS

To make it easier for our examiner to understand the objective of the invention, its structure, innovative features, and performance, we use a preferred embodiment and the attached drawings for the detailed description of the invention.

Figure 1A:
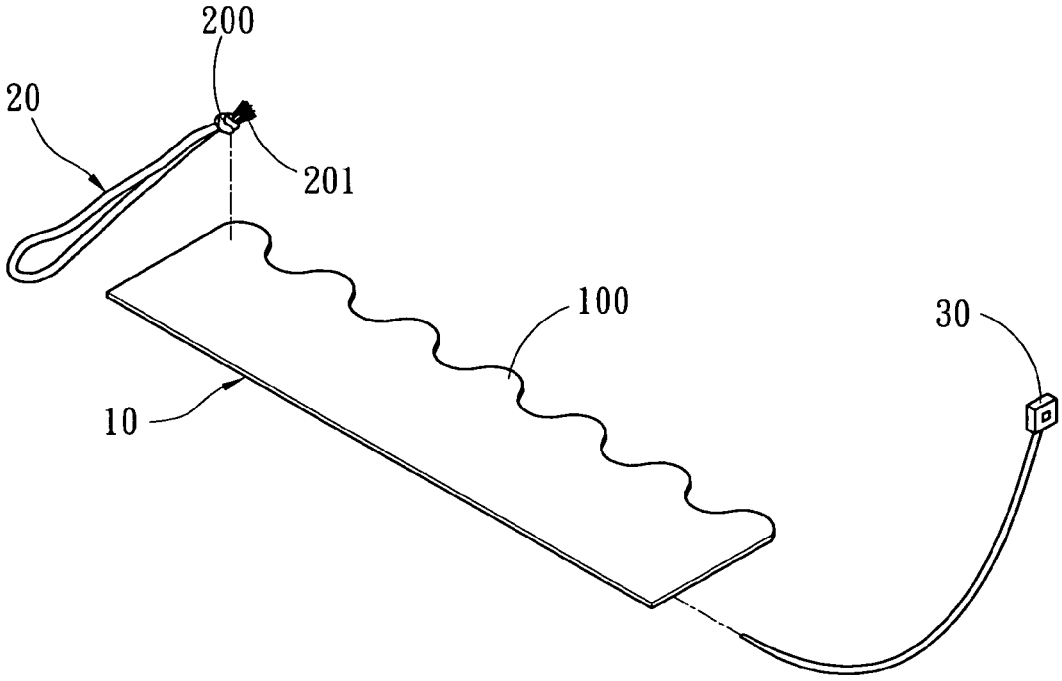
FIGS. 1A~1F are views of the steps of manufacturing mess sponges according to the present invention.
Figure 1B:
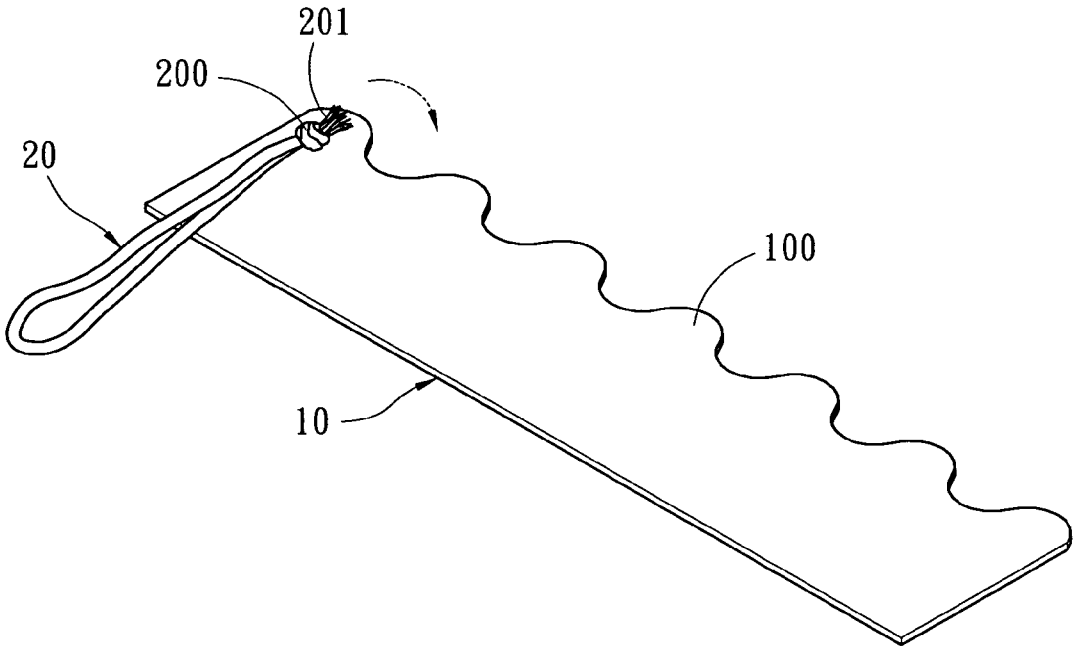
Figure 1C:
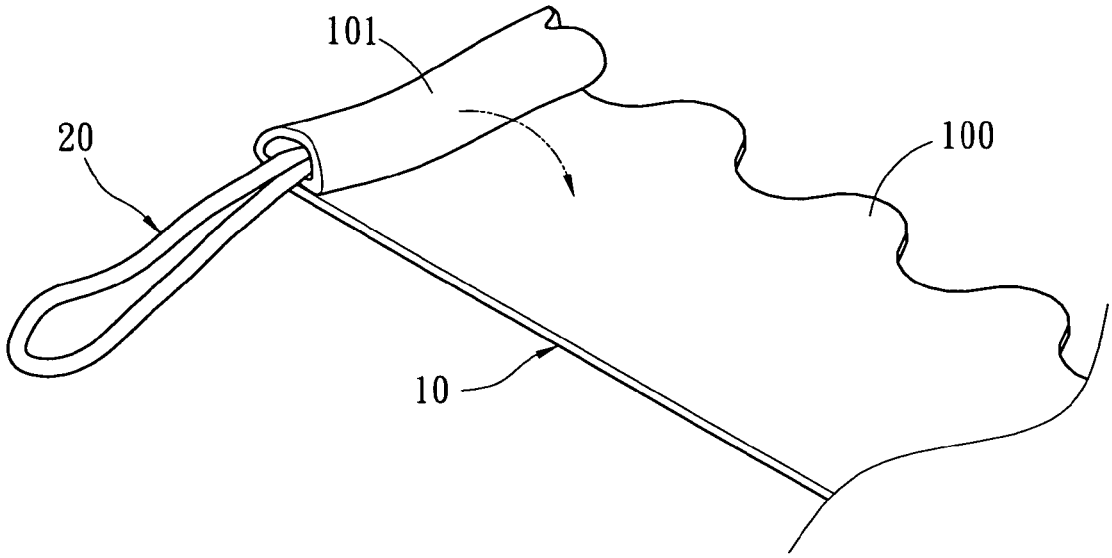
Figure 1D:
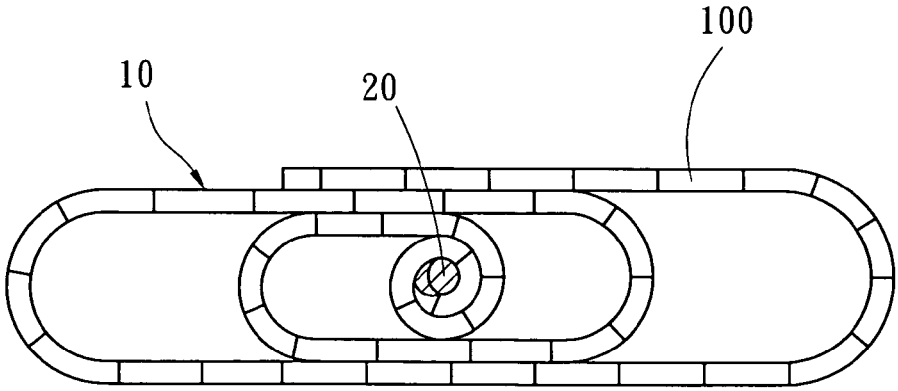
Figure 1E:
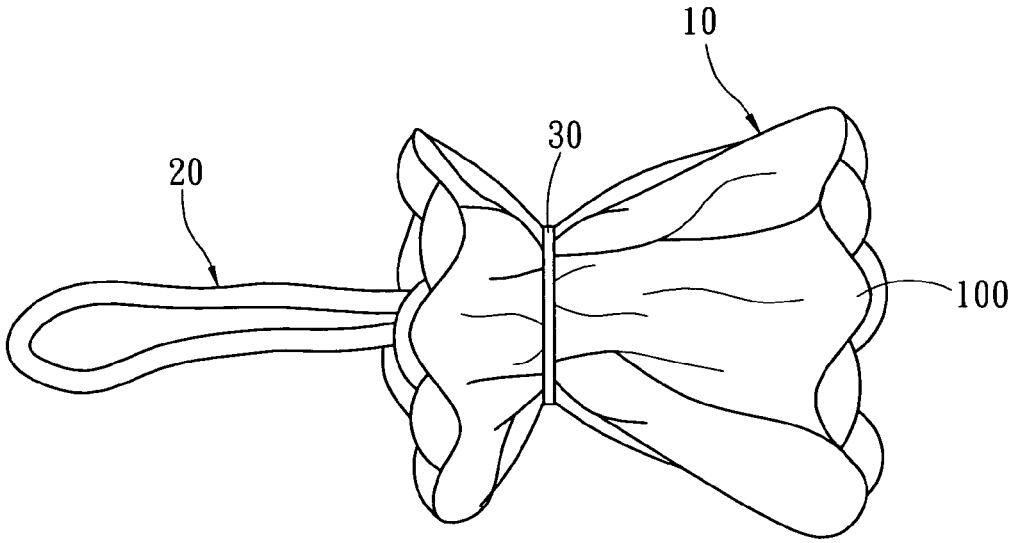
Figure 1F:
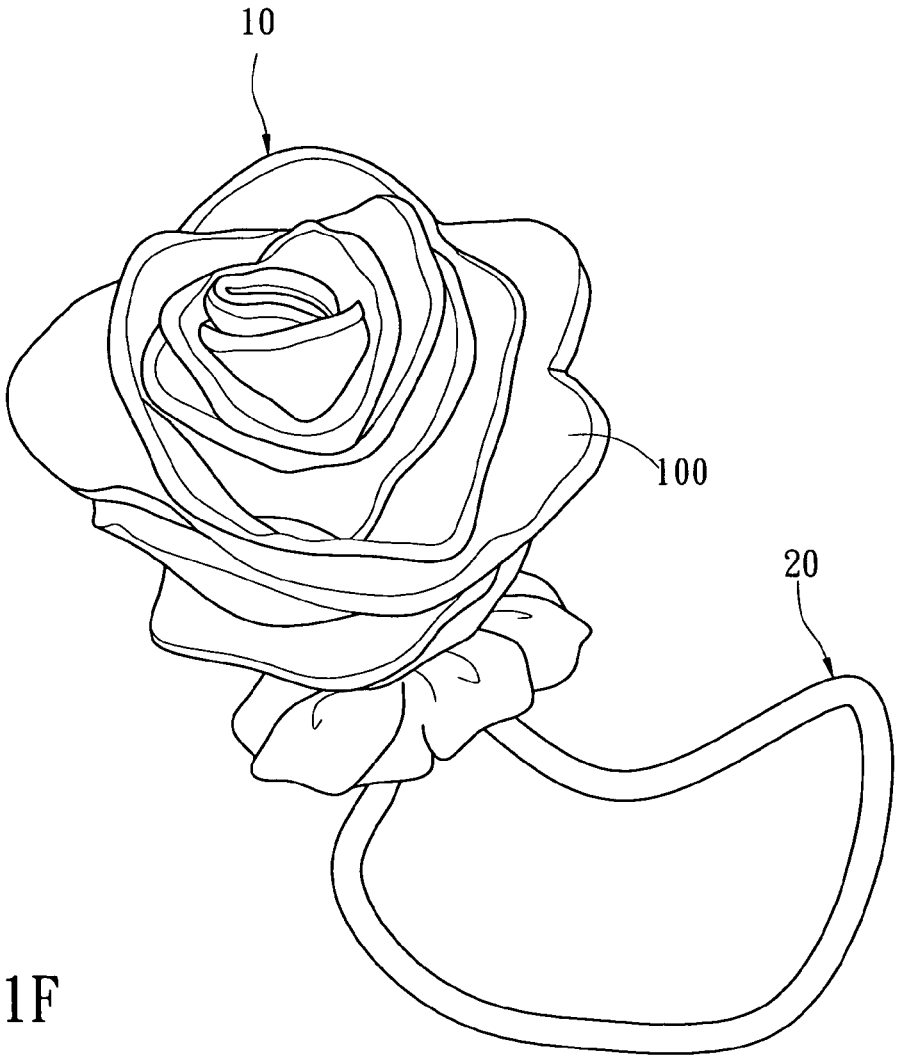

Please refer to FIGS. 1A, and 1F for a mess sponge structure according to the present invention, primarily providing a sponge 10 made of a soft PVA film material or a sponge material, which uses a folding method to repeatedly folding a sponge 10 in the same direction for several times to form a flower-shaped structure having a plurality of wavy pedals and pistils/stamina 201, and comprises:

at least one sheet sponge 10, being made of a soft PVA film or a sponge material and having an external appearance with the lines of irregular continuous wavy pedals disposed on the sponge 10;

a rope 20, having a knot 200 disposed on one end, and an end having the knot 200 disposed on a stylish edge 100 of the sponge 10, and the rope 20 being perpendicular to the stylish edge 100, and the knot 200 extending a plurality of yarns to form the pistil/stamen 201 of the flower shape; and a binder 30, having a binding function.

Figure 2:
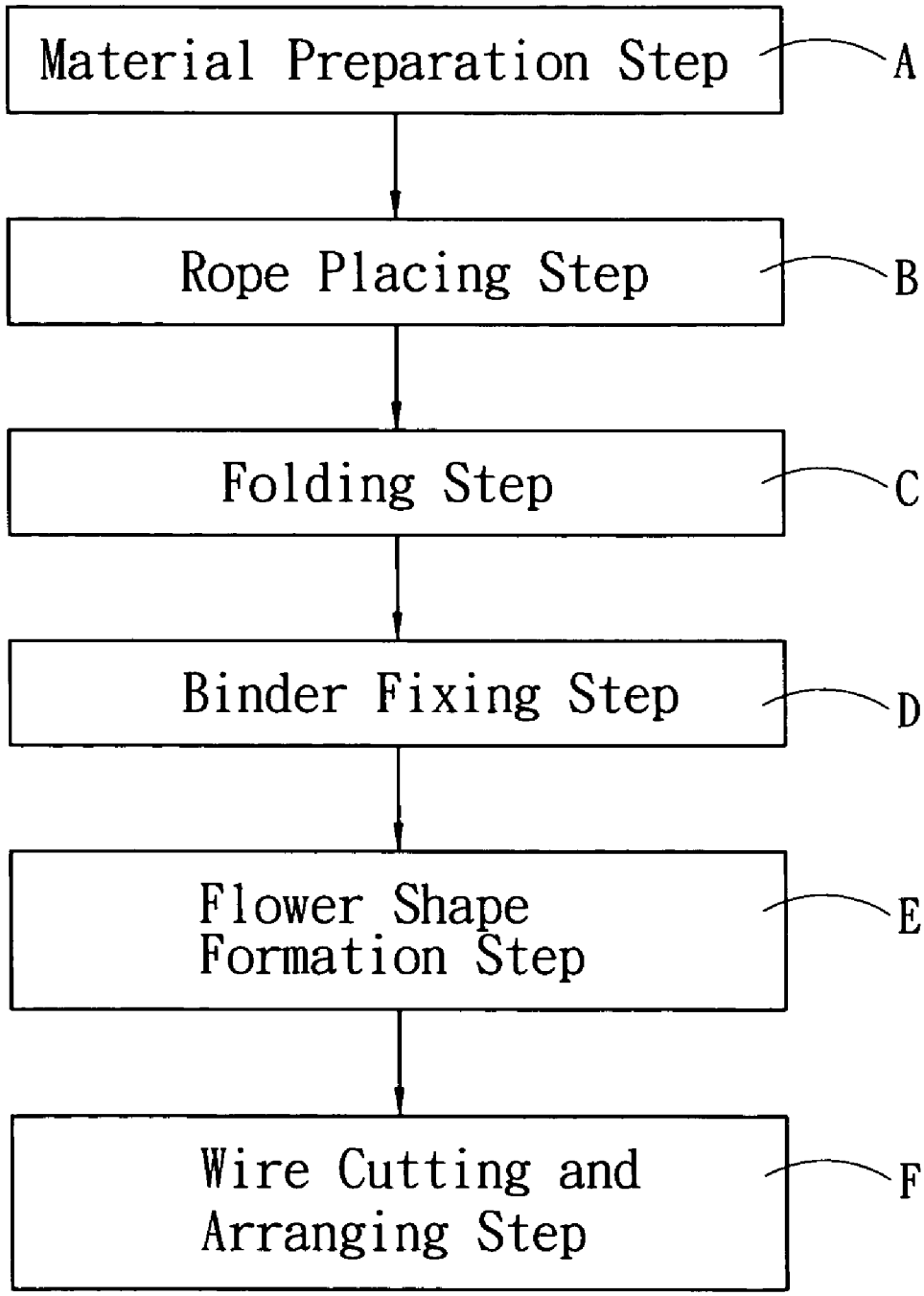
FIG. 2 is a flow chart of the present invention.

Please refer to FIGS. 1A, 1F and 2 for the method of manufacturing mess sponges according to the invention, which comprises the steps of:

(A) Material Preparation Step: preparing at least one sheet of a long-bar shaped sponge 10 having at least one stylish edge 100 with continuous semicircular wavy pedals, a rope 20 and a binder 30;

(B) Rope Placing Step: placing an end of a rope 20 having a knot 200 onto the stylish edge 100 of the sponge 10 such that the rope 20 is perpendicular to the stylish edge 100; wherein the rope 20 has the knot 200 at one end and the knot 200 extends a plurality of yarns and the plurality of yarns form the pistil/stamen 201 of the flower-shaped structure;

(C) Folding Step: folding the sponge 10 with a specific distance around the periphery of the knot 200 along the stylish edge 100 of the sponge 10 such that the sponge 10 being tightly wrapped around the periphery of the knot 200, and then repeatedly folding the sponge 10 with a specific distance in the same folding direction to press tightly at a central section 101;

(D) Binder Fixing Step: using the binder 30 to wrap around a position ⅓ of the distance from the knot 200 of the folded sponge 10, and then tightly wrap the binder 30;

(E) Flower Shape Formation Step: bending the sponge 10 on both sides of the central section 101 towards the tightly wrapped position of the binder 30, such that the appearance forms a flower shape look;

(F) Wire Cutting and Arranging Step: cutting off the section remained after tying the binder 30 as described in Step (F), such that the sponge 100 is in a complete flower-shaped structure.

Figure 3A:
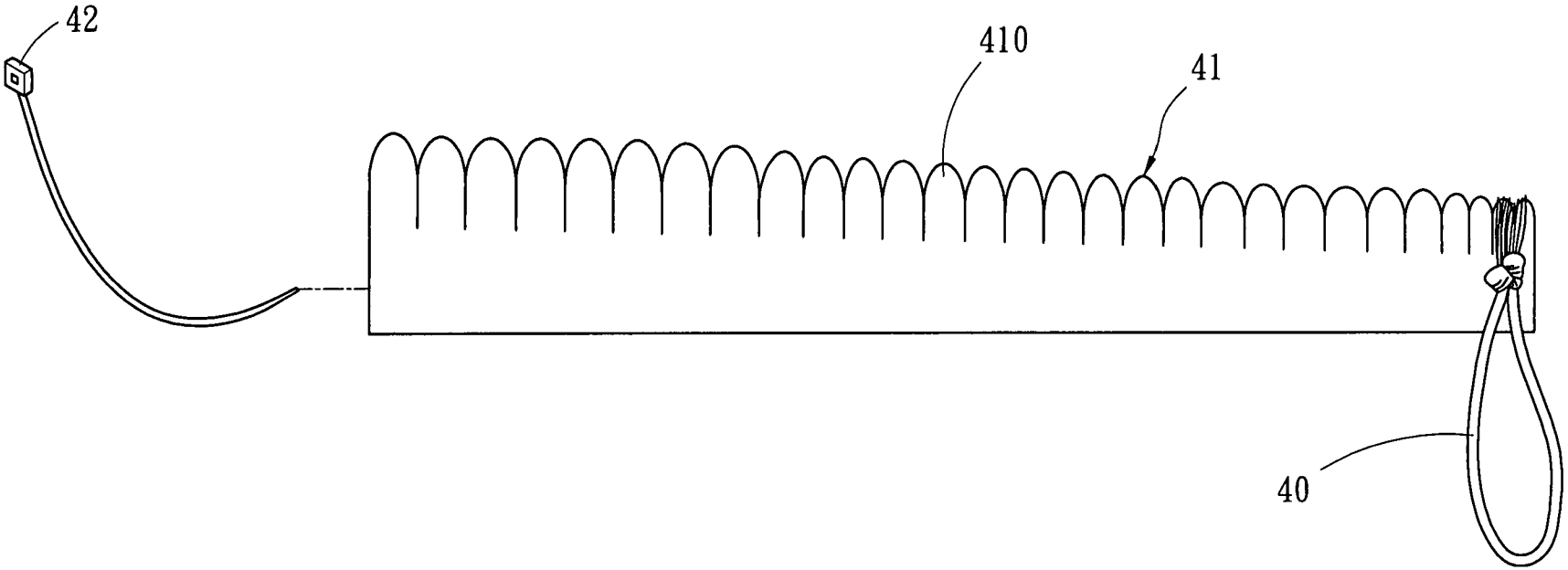
FIGS. 3A and 3B are views of a second preferred embodiment of the present invention.
Figure 3B:
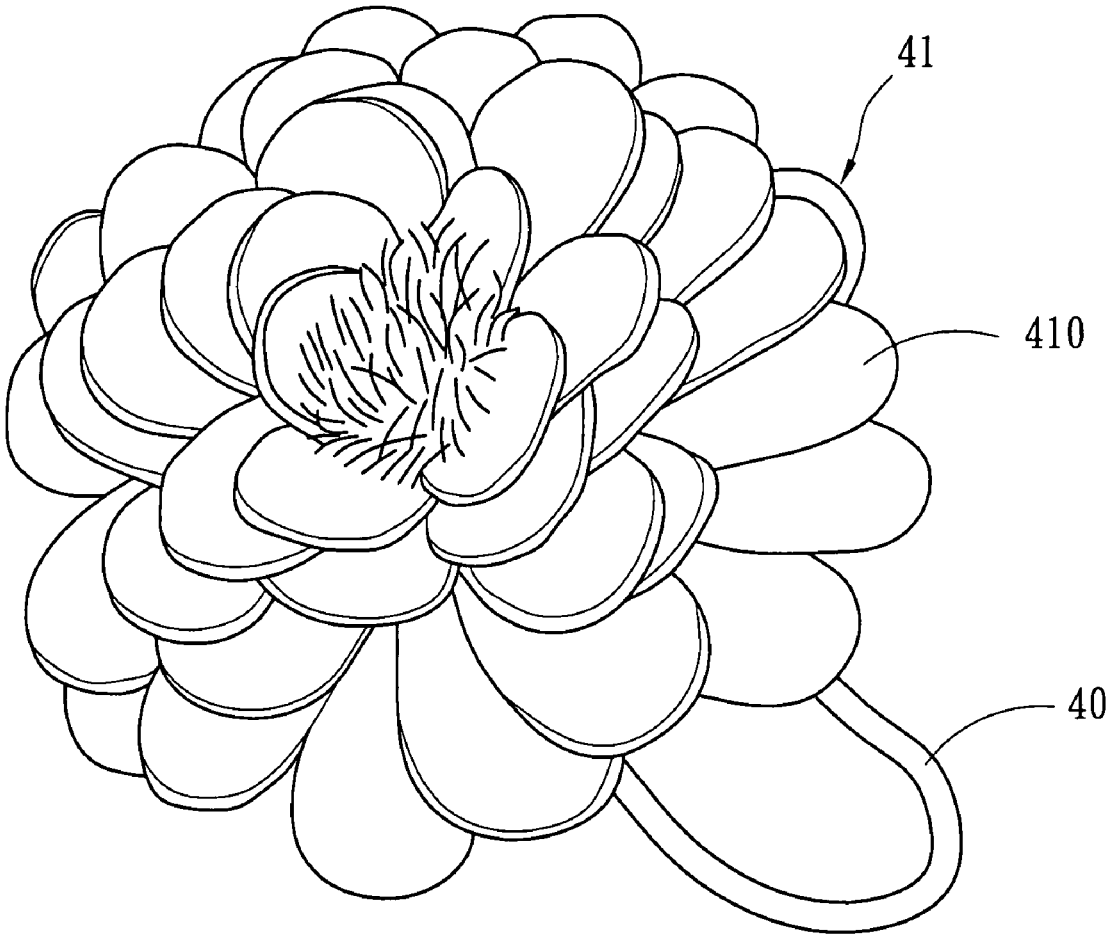

Please refer to FIGS. 3A and 3B for a second preferred embodiment of the present invention. In the figures, the invention comprises a sponge 41, a rope 40 and a binder 42; wherein a stylish edge 410 of the sponge 41 is a continuous strip-like wavy pedal with gradually increasing length constituting another flower-shaped structure.

Figure 4A:
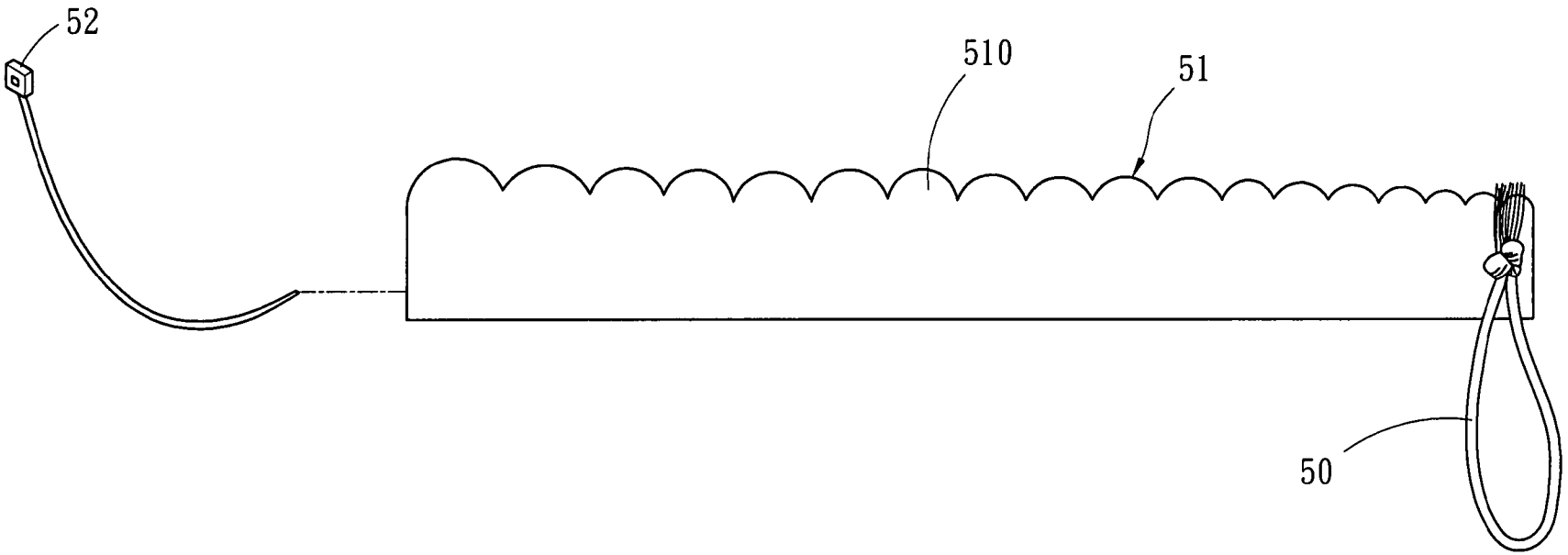
FIGS. 4A and 4B are views of a third preferred embodiment of the present invention.
Figure 4B:
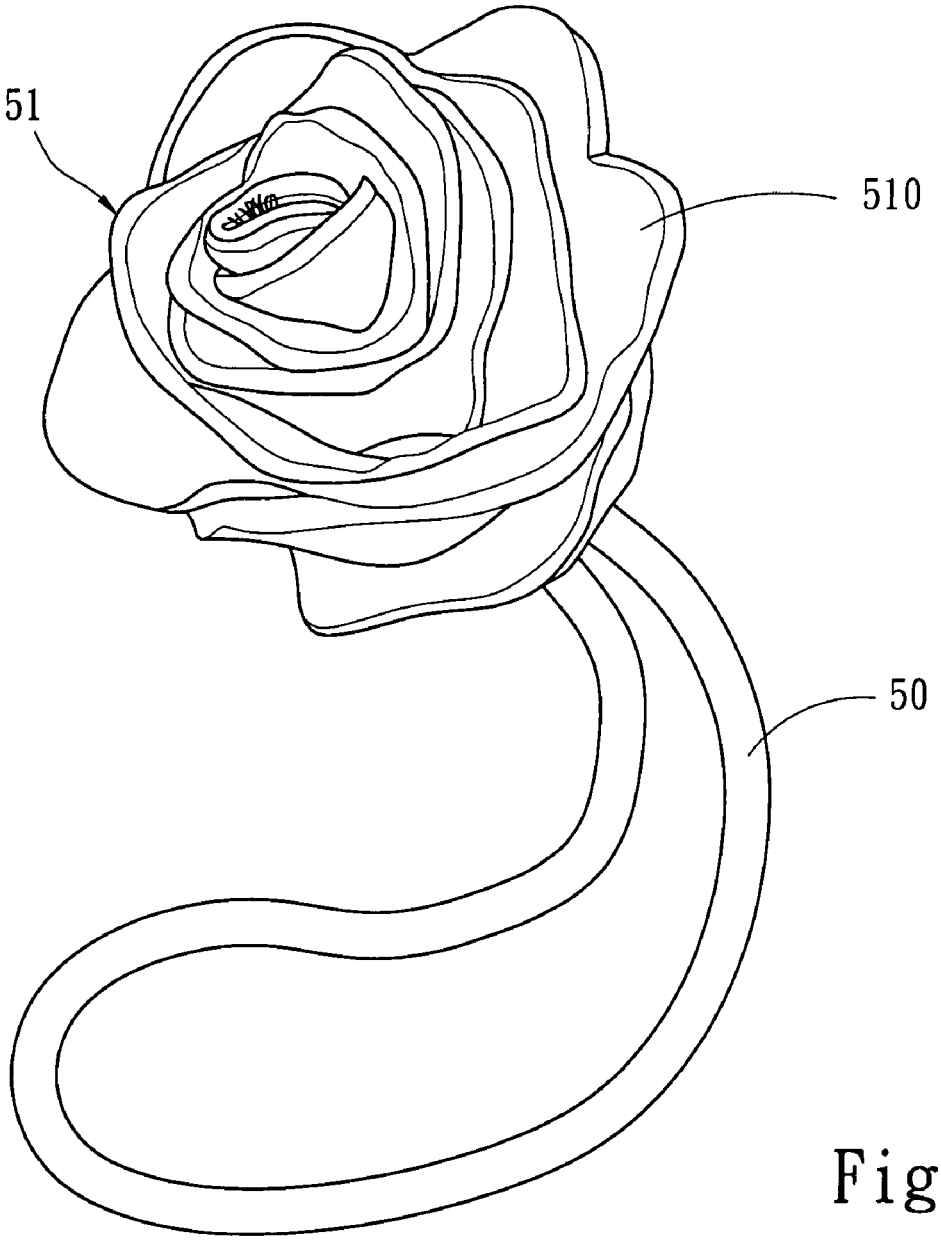

Please refer to FIGS. 4A and 4B for a third preferred embodiment of the present invention. In the figures, the invention comprises a sponge 51, a rope 50 and a binder 52; wherein a stylish edge 510 of the sponge 51 is a continuous semicircular wavy pedal with gradually increasing length constituting another flower-shaped structure.

Figure 5A:
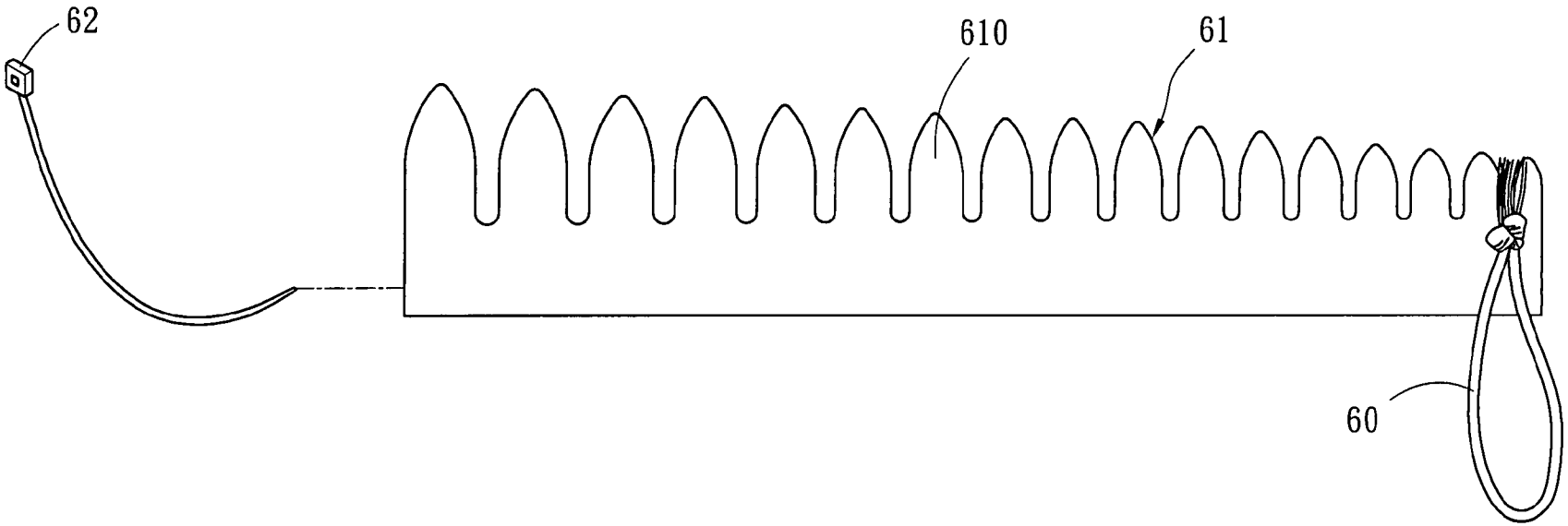
FIGS. 5A and 5B are views of a fourth preferred embodiment of the present invention.
Figure 5B:
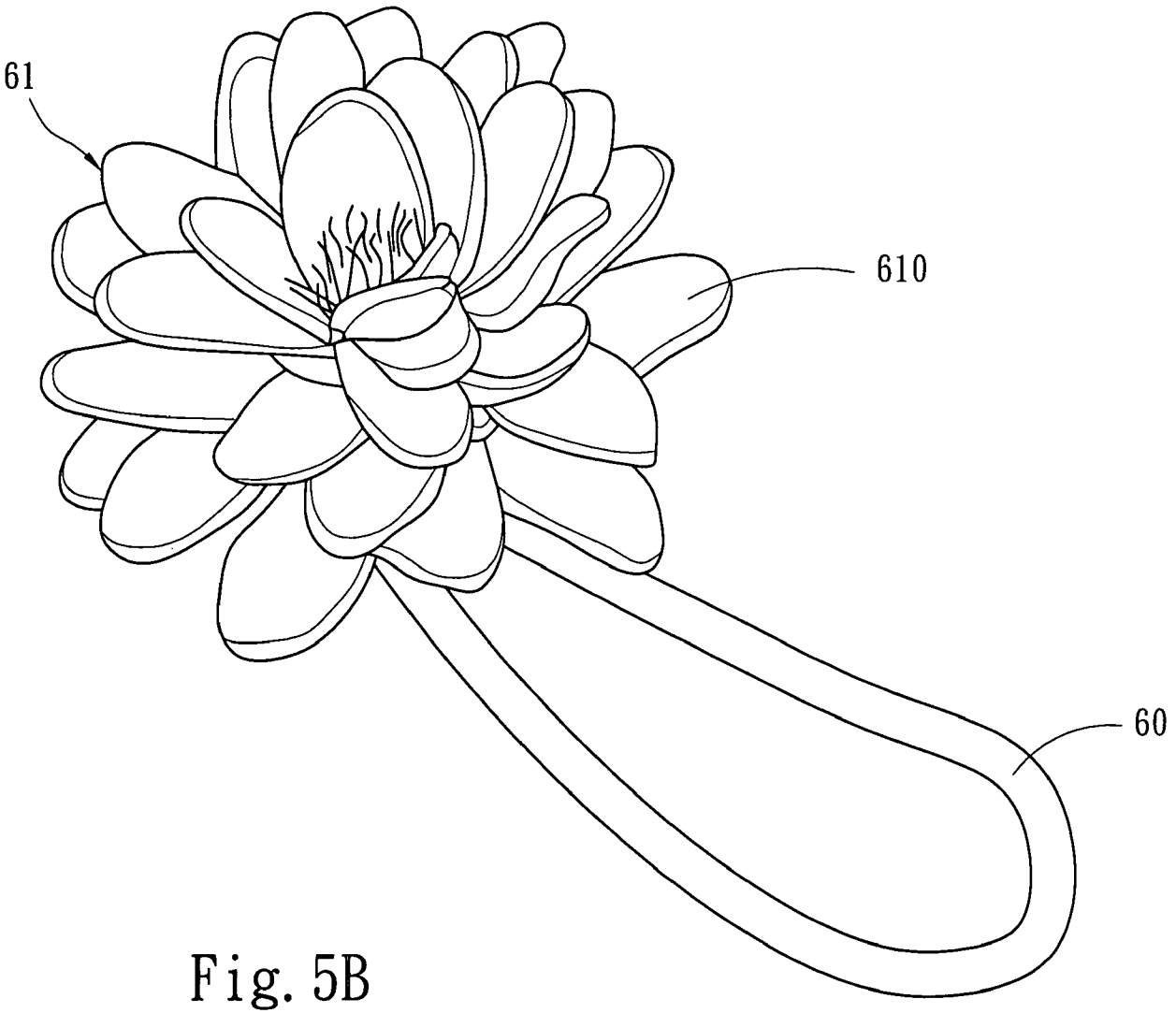

Please refer to FIGS. 5A and 5B for a fourth preferred embodiment of the present invention. In the figures, the invention comprises a sponge 61, a rope 60 and a binder 62; wherein a stylish edge 610 of the sponge 61 is a continuous slender wavy pedal with gradually increasing length constituting another flower-shaped structure.

In summation of the description above, the method for manufacturing mess sponges according to the invention repeatedly folds sheets of sponges into a flower-shaped structure having a plurality of pedals and pistils/stamina, and different shapes of the stylish edges constitute different flower-shaped structures. The sponge can be used to rub a dirtier position of the body due to its higher density for adhering soap and stronger rubbing force, and the flower-shaped structure so produced can clean softer parts of the body, and thus greatly improving the convenience of rubbing our bodies.

What is claimed is:

1. A method of tying and manufacturing mess sponges, comprising the steps of:

(A) Material Preparation Step: preparing at least one sheet of a long-bar shaped sponge having at least one stylish edge, a rope and a binder;

(B) Rope Placing Step: placing an end of said rope having a knot onto said stylish edge of said sponge such that said rope being perpendicular to said stylish edge;

(C) Folding Step: folding said sponge with a specific distance around the periphery of said knot along said stylish edge of said sponge such that said sponge tightly wrapping around the periphery of said knot, and then repeatedly folding the sponge with a specific distance in the same folding direction to press tightly on a central section;

(D) Binder Fixing Step: using said binder to wrap around a position ⅓ of the distance from said knot of said folded sponge, and then tightly wrapping said binder;

(E) Flower Shape Formation Step: bending both sides of said central section of said sponge towards said binder to constitute said flower-shape appearance;

(F) Wire Cutting and Arranging Step: cutting off a section remained after tying said binder as described in Step (E), such that said sponge being in a complete flower-shaped structure.

2. The method of manufacturing mess sponges of claim 1, wherein said sponge is made of a soft PVA film material.

3. The method of manufacturing mess sponges of claim 1, wherein said sponge is made of a sponge material.

4. The method of manufacturing mess sponges of claim 1, wherein said stylish edge is a continuous semicircular wavy pedal.

5. The method of manufacturing mess sponges of claim 1, wherein said stylish edge is a continuous strip-like wavy pedal with gradually increasing length.

6. The method of manufacturing mess sponges of claim 1, wherein said stylish edge is a continuous semicircular wavy pedal with gradually increasing length.

7. The method of manufacturing mess sponges of claim 1, wherein said stylish edge is a continuous slender wavy pedal gradually increasing length.

8. The method of manufacturing mess sponges of claim 1, wherein said stylish edge forms a different flower-shaped structure with a different shape of said edge.

9. The method of manufacturing mess sponges of claim 1, wherein said rope having said knot at one end extends a plurality of yarns, and said plurality of yarns constitute said pistils/stamina of said flower-shaped structure.

* * * * *